US005120462A

United States Patent [19]

Buchwald et al.

[11] Patent Number: 5,120,462

[45] Date of Patent: Jun. 9, 1992

[54] DICHLOROPENTAFLUOROPROPANES AND ACETONE COMPOSITIONS

[75] Inventors: Hans Buchwald, Ronnenberg; Andreas Brackmann, Hanover; Boleslaus Raszkowski, Wiedensahl, all of Fed. Rep. of Germany

[73] Assignee: Kali-Chemie AG, Hanover, Fed. Rep. of Germany

[21] Appl. No.: 678,432

[22] Filed: Apr. 1, 1991

[30] Foreign Application Priority Data

Apr. 3, 1990 [DE] Fed. Rep. of Germany ..... 4010682
Jul. 19, 1990 [DE] Fed. Rep. of Germany ..... 4022927

[51] Int. Cl.[5] ..... C11D 7/30; C11D 7/50; C23G 5/028

[52] U.S. Cl. ..... 252/171; 134/12; 134/31; 134/38; 134/39; 134/40; 203/67; 252/162; 252/170; 252/364; 252/DIG. 9

[58] Field of Search ..... 252/162, 170, 171, 172, 252/364, DIG. 9, 67; 134/12, 31, 38, 39, 40; 203/67

[56] References Cited

U.S. PATENT DOCUMENTS

| | | | |
|---|---|---|---|
| 3,483,034 | 12/1969 | Ensminger | 134/1 |
| 4,252,601 | 2/1981 | Ceintrey | 252/364 |
| 4,947,881 | 8/1990 | Magid et al. | 134/40 |

FOREIGN PATENT DOCUMENTS

| | | | |
|---|---|---|---|
| 347924 | 12/1989 | European Pat. Off. . | |
| 1497235 | 5/1969 | Fed. Rep. of Germany . | |
| 54-099134 | 8/1979 | Japan | 252/171 |
| 2-202998 | 8/1990 | Japan . | |
| WO89/12674 | 12/1989 | PCT Int'l Appl. . | |
| 2029325 | 3/1980 | United Kingdom . | |
| WO90/08814 | 8/1990 | World Int. Prop. O. . | |
| WO90/08815 | 8/1990 | World Int. Prop. O. . | |

*Primary Examiner*—Paul Lieberman
*Assistant Examiner*—Linda D. Skaling
*Attorney, Agent, or Firm*—Foley & Lardner

[57] ABSTRACT

Azeotropic and azeotrope-like compositions composed of dichloropentafluoropropanes and acetone are described which are suitable for use in cleaning processes and in printing and copying processes for fixing toner based on polystyrene.

11 Claims, No Drawings

DICHLOROPENTAFLUOROPROPANES AND ACETONE COMPOSITIONS

BACKGROUND OF THE INVENTION

The present invention relates to new compositions composed of hydrogen-containing fluorochlorohydrocarbons and acetone. The fluorochlorohydrocarbons are selected from the group consisting of dichloropentafluoropropanes. It further relates to the use of these compositions for cleaning surfaces of objects or for fixing toner which is applied to a recording carrier in the fixing apparatus of printers and copiers.

Very high demands are placed on solvents for cleaning purposes and for fixing toner. Such solvents should have a relatively low boiling point, should be nonflammable and largely non-toxic, and should have beneficial solvent properties for impurities which are to be removed or for toner particles which are applied to a recording material and are to be fixed by solubilizing. However, these demands, as a rule, cannot be met by only one single pure solvent. Therefore, in practice, a large number of solvent mixtures with differing compositions are used. For instance, it is generally known to use mixtures of fluorochlorohydrocarbons (as the main solvent) with a co-solvent for industrial cleaning processes or for vapor degreasing in addition to pure chlorinated and/or fluorinated hydrocarbons. Such mixtures may be either nonazeotropic, azeotropic or azeotrope-like. "Azeotrope-like" is understood to mean that mixtures boil substantially constantly over a relatively large concentration range (change in boiling temperature of not more than 5° C.) and, therefore, behave similarly to azeotropes for practical use. Solvent mixtures which when boiling contain in the vapor phase the solvent constituents of the mixture in the same relative composition as in the liquid phase are regarded as azeotropes. Solvent mixtures which are suitable for use in fixing apparatus of printers and copiers generally consist of at least two solvent constituents, at least one of which has toner-solubilizing properties. Since solvent mixtures in modern fixing apparatus act on the toner in the vapor state, the solvent mixture should evaporate as evenly as possible, i.e. without separating into the constituents or at least without relatively large shifts in the proportions of the constituents, in order to ensure continuous fixing of the toner on the recording material even over relatively long periods of use. For this purpose, the preferred solvent mixture used in the fixing apparatus has azeotrope-like, but most preferably azeotropic, boiling properties. However, it is not possible to predict the formation of azeotropic or azeotrope-like compositions, which renders the search for new azeotropic or azeotrope-like solvent systems more difficult.

Although many attempts have already been made to obtain compositions with the desired properties for different fields of use, the known mixtures are still inadequate because they either are unsuitable for certain purposes, are toxic or adversely affect the environment. For instance, in conjunction with the further technical developments in the field of fluxes, new demands have arisen relating to the removal of the newly developed fluxes. Known solvent mixtures are frequently unsatisfactorily for this purpose. Furthermore, known solvent mixtures are often multi-component systems of complicated composition or contain relatively large proportions of solvents which are toxic or have low flash points, and are, therefore, unsafe. For a range of solvent constituents, further replacement by other solvents which are at least equally well suited for the respective purposes is desirable from an environmental standpoint.

SUMMARY OF THE INVENTION

The object of the invention is to provide new azeotropic or azeotrope-like solvent mixtures which overcome the drawbacks of the prior art.

Another object is to provide azeotropic or azeotrope-like solvent mixtures which are particularly well suited for cleaning purposes, for use in the removal of modern fluxes and/or for use as solvents in fixing apparatus of printers and copiers.

These and other objects of the invention are achieved by providing an azeotropic or azeotrope-like composition comprised of (a) 90.0 to 80.0% by weight of at least one hydrogen-containing fluorochlorohydrocarbonselected from the group consisting of dichloropentafluoropropanes; and (b) 10.0 to 20.0% by weight acetone; wherein the sum of (a) and (b) is 100% by weight.

DETAILED DESCRIPTION OF PREFERRED EMBODIMENTS

The invention relates to novel azeotrope-like compositions which are distinguished by a content of 90.0 to 80.0% by weight of at least one hydrogen-containing fluorochlorohydrocarbon selected from the group consisting of dichloropentafluoropropanes and by a content of 10.0 to 20.0% by weight of acetone, wherein the sum of the constituents is 100% by weight.

As used herein, "dichloropentafluoropropanes" refer to the fluorochlorohydrocarbons carrying a single hydrogen atom and having the empirical formula $C_3HCl_2F_5$. These include, in particular, the incompletely halogenated isomeric fluorochlorohydrocarbons 1,2-dichloro-1,2,3,3-pentafluoropropane, 2,3-dichloro-1,1,1,2,3-pentafluoropropane, 1-dichloro-2,2,3,3,3-pentafluoropropane (3,3-dichloro-1,1,1,2,2-pentafluoropropane), 1,3-dichloro-1,1, 2,2,3-pentafluoropropane, 1,1-dichloro-1,2,2,3,3-pentafluoropropane, 1,2-dichloro-1,1,3,3,3-pentafluoropropane, and 1,1-dichloro-1,2,3,3,3-pentafluoropropane. Preferred dichloropentafluoropropanes are 1,1-dichloro-2,2,3,3,3-pentafluoropropane (R225ca) or 1,3-dichloro-1,1,2,2,3-pentafluoropropane (R225cb) or a mixture thereof.

The compositions of the present invention are distinguished by having azeotropic or azeotrope-like behavior which provides certain use-related advantages. For instance, the compositions of the present invention boil at a constant temperature which remains constant or substantially constant throughout. Furthermore, fractionation of the solvent constituents of the compositions does not occur, so that unwanted changes, such as reduced solvent power, reduced inertness to items to be cleaned or increased flammability by accumulation of flammable co-solvents, do not occur. Furthermore, the azeotropic or azeotrope-like compositions can be purified easily by conventional distillation after use and are thus readily available for re-use without the characteristics of the original composition being lost.

The preferred binary or ternary compositions comprising 1,1-dichloro-2,2,3,3,3-pentafluoropropane (R225ca) and/or 1,3-dichloro-1,1,2,2,3-pentafluoropropane (R225cb) and acetone have very narrow, azeotrope-like boiling ranges. The preferred binary azeotrope-like compositions comprising 90.0 to 80.0% by weight of 1,1-dichloro 2,2,3,3,3-pentafluoropropane (R225ca) or 1,3-dichloro-1,1,2,2,3-pentafluoropropane (R225cb) in a mixture with 10.0 to 20.0% by weight of acetone, boil within a range of 51° to 56° C. at atmospheric pressure. A particularly preferred binary azeotropic composition comprising approximately 85.2% by weight of b 1,1-dichloro-2,2,3,3,3-pentafluoropropane (R225ca) and 14.8% by weight acetone has a boiling point of approximately 55.5° C. at atmospheric pressure. The preferred ternary azeotrope-like compositions of the invention are comprised of 90.0 to 80.0% by weight of a mixture of the isomers 1,1-dichloro-2,2,3,3 ,3pentafluoropropane (R225ca) and 1,3-dichloro 1,1,2,2,3-pentafluoropropane (R225cb) in a mixture with 10.0 to 20.0% by weight of acetone and boil in a range of 55° to 56.5° C. at atmospheric pressure. In the most preferred ternary compositions, the isomers 1,1-dichloro-2,2,3,3,3-pentafluoropropane (R225ca) and 1,3-dichloro-1,1,2,2,3-pentafluoropropane (R225cb) are present in a weight ratio of from 1:3 to 1:5.5 to each other. Weight ratios for the isomer mixture of R225ca and R225cb of approximately 1:4 are particularly preferred. A particularly preferred ternary azeotropic composition containing approximately 85.8% by weight of a mixture of the isomers 1,1-dichloro-2,2,3,3,3-pentafluoropropane (R225ca) and 1,3-dichloro-1,1,2,2,3-pentafluoropropane (R225cb) and 14.2% by weight of acetone has a boiling point of approximately 55.7° C. at atmospheric pressure.

The azeotropic or azeotrope-like compositions of the present invention have advantageous solvent properties, making them suitable for many purposes, but particularly for cleaning the surfaces of objects or for use as solvents in fixing apparatus of printers and copiers.

The compositions according to the invention are solutions which are clear at room temperature, and to which known additives may be added. Thus, the relative ratio of dichloropentafluoropropane to acetone defined by the foregoing weight % values is not altered by the addition of additives.

One group of known additives is stabilizers. This group includes compounds which prevent an undesirable reaction of constituents of the composition with each other or with other reactants, such as atmospheric oxygen, metal or water. Known stabilizers include nitroalkanes, in particular nitromethane, nitroethane; alkylene oxides, in particular butylene oxide; or branched alkynols such as 2-methyl-butyn-(3)-ol-(2). These stabilizers may be used singly or in combination, with highly suitable quantities being from 0.01 to 5% by weight, preferably from 0.05 to 1% by weight, relative to the total mixture.

Other known additives include corrosion inhibitors, non-ionic or ionic emulsifiers, and dyes.

The compositions according to the invention may be used for many purposes, but are particularly useful for cleaning and/or vapor degreasing. According to known processes, the object to be cleaned is either immersed into a liquid and/or vaporous cleaning mixture or is sprayed with such liquid cleaning mixture in one or more stages. The cleaning action may be enhanced by using the composition at boiling temperature, by applying ultrasound, or by stirring. The cleaning action may also be improved by including mechanical action such as brushing.

The compositions of the present invention are particularly useful in the electronics industry wherein excess organic resin fluxes used for soldering must be removed from circuit boards after the soldering operation. The removal of the fluxes must be accomplished with organic solvents which are compatible and non-reactive with the circuit boards and the electronic components. The resin fluxes to be removed are mixtures of polar and non-polar compounds and often additionally contain special activators. Dichloropentafluoropropanes alone, which are non-polar, are neither effective for removing the polar components of the resins nor capable of completely removing special high activator-containing fluxes. Surprisingly, however, the compositions composed of dichloropentafluoropropanes and acetone according to the present invention are able to remove both the polar and the non-polar constituents and are therefore generally effective as removal agents for resin fluxes, particularly for those having a high activator content. The compositions comprising 1,1-dichloro-2,2,3,3,3-pentafluoropropane (R225ca), which are preferably azeotropic and optionally contain stabilizers, are particularly well suited for this use.

Thus, the compositions of the present invention may be used to clean circuit boards with or without inserted components such as SMD-components, without producing the "white coating" associated with conventional cleaning agents. This is true even when fluxes having high activator contents have been used.

The low surface tension, the high wetting power and the density of the compositions according to the invention also make them particularly suitable for cleaning capillary systems.

The compositions according to the invention may also be used for cleaning small parts or bulk material, preferably in closed devices; for stripping paint; and as special solvents, extraction agents and/or recrystallization agents in the chemical and pharmaceutical industries.

Additionally, the new azeotropic and azeotrope-like compositions according to the invention may be used for fixing toner onto recording carriers in printers and copiers. The invention, therefore, also relates to the use of the azeotrope-like or azeotropic compositions in the fixing apparatus of printers and copiers. The compositions according to the invention used for this purpose may also contain stabilizers.

The azeotrope-like or azeotropic compositions according to the invention solubilize dry toners based on polystyrene particularly well. In the printing and copying process, a charge image (negative image) is first produced on a photoconductor drum by exposing the document to be printed or copied, which image is then developed in a subsequent developing station, i.e. the charged image is provided with toner. The developed charge images on the photoconductor drum then pass into a transfer printing station. Using an electrostatic field in the transfer printing station, the toner image is transferred onto a record carrier such as a continuous strip of paper or a single sheet supplied to the transfer printing station. The toner image then adheres to the surface of the record carrier, although it can be smeared. The record carrier provided with the toner image (positive image) is then passed through a fixing apparatus. In this fixing apparatus, the vapor necessary for fixing is produced. For this purpose, the solvent is disposed at the bottom of the housing of the fixing apparatus. The bottom of the fixing apparatus is heated by means of a heating apparatus so that the solvent evaporates from the base. The resulting solvent vapor acts on the record carrier, in particular, on the toner applied thereto. This solubilizes the toner, so that it can penetrate into the record carrier. After this fixing operation, the record carriers are freed, by drying, of any residues of the solvent vapor which may still be adhering, and a dry, well-adhering and non-smearing toner image is obtained on the record carrier.

The compositions according to the invention, composed of incompletely halogenated fluorochlorohydrocarbons selected from the group consisting of the dichloropentafluoropropanes and which contain acetone as a co-solvent, provide the high degree of purity which is necessary in special fields of use, such as for cleaning components and circuit boards in the electronics industry. The characteristics of these novel compositions are not inferior to those of the fully halogenated prior art fluorochlorohydrocarbon compositions. It is all the more surprising that the novel compositions of the present invention, unlike many prior art mixtures, also have outstanding cleaning properties without the addition of polar additives to increase the solvent power. Furthermore, the azeotropic and azeotrope-like compositions according to the invention have very good toner-solubilizing properties, especially for dry toners based on polystyrene. These compositions are able to solubilize the toner particles very well without causing unwanted bleeding or blotting of the toner on the record carrier. This enables production of well-adhering, non-smearing images with high resolution or sharpness on the record carrier. Another advantage of the compositions according to the invention is that these compositions have increased flash points, or in the case of the azeotropes have no flash points, when used in a closed crucible method. Therefore, the compositions according to the invention, permit new solutions to problems in many fields of use. Finally, it is also advantageous that the incompletely halogenated fluorochlorohydrocarbon solvents of the invention are more readily degradable and are thus considerably better for the environment than the fully halogenated fluorochlorohydrocarbons.

The invention will be illustrated in further detail by the following examples which are not intended to limit the scope of the invention. Unless stated otherwise, % means % by weight.

EXAMPLES

Example 1: Cleaning of Circuit Boards, Glass Lenses and Aluminum Plates

Cleaning tests were conducted on circuit boards which were contaminated with conventional halogen-containing soldering fluxes as well as with high-activator-containing soldering fluxes. The tests were carried out in a commercially available 2-chamber cleaning unit. Using the compositions of the present invention, it was possible to remove from the circuit boards both the impurities due to conventional halogen-containing soldering fluxes and those due to high-activator-containing fluxes with outstanding cleaning results. Furthermore, glass lenses and aluminum plates contaminated with oil and/or grease were cleaned. The cleaning compositions, cleaning conditions and cleaning results are reproduced in Table 1.

TABLE 1

| No. | Compositions for bath 1 and 2 | Cleaning conditions 2-bath: | Material | Result |
|---|---|---|---|---|
| 1 | R225ca/acetone: 90.0%/10.0% | 1) 3 min. ultra-sound<br>2) 1 min. vapour degreasing | a) Circuit boards<br>b) Glass lenses<br>c) aluminium plates | ++<br>++<br>++ |
| 2 | R225ca/acetone: 85.2%/14.8% | 1) 3 min. ultra-sound<br>2) 1 min. vapour degreasing | a) Circuit boards<br>b) Glass lenses<br>c) aluminium plates | ++<br>++<br>++ |
| 3 | R225/acetone: 90.0%/10.0% Weight ratio R225ca:R225cb = 1:4 | 1) 3 min. ultra-sound<br>2) 1 min. vapour degreasing | a) Circuit boards<br>b) Glass lenses<br>c) aluminium plates | ++<br>++<br>++ |
| 4 | R225/acetone: 85.8%/14.2% Weight ratio R225ca:R225cb = 1:4 | 1) 3 min. ultra-sound<br>2) 1 min. vapour degreasing | a) Circuit boards<br>b) Glass lenses<br>c) aluminium plates | ++<br>++<br>++ |

In Table 1, the "++" in the "Result" column, means that a very good cleaning effect was achieved, and that there was no formation of "white coatings". With regard to the cleaning of glass lenses and aluminum plates, "++" means that these items were completely free of oil or grease after cleaning. It is clear from the results in Table 1 that the compositions according to the invention show outstanding cleaning power.

Example 2: Cleaning of Bulk Material a) Bulk material (transistor caps) was cleaned in a 2-chamber unit (3 minutes ultrasound, 1 minute vapor degreasing) with an azeotropic composition of 85.2% R225ca and 14.8% acetone in order to remove drawing oils. The bulk material was satisfactorily clean after treatment.

b) Bulk material (transistor caps) was cleaned in a 2-chamber unit (3 minutes ultrasound, 1 minute vapor degreasing) with an azeotropic mixture of 85.8% R225 (R225ca:R225cb in a weight ratio of 1:4) and 14.2% acetone in order to remove drawing oils. The bulk material was satisfactorily clean after treatment.

The foregoing description and examples have been set forth merely to illustrate the invention and are not intended to be limiting. Since modifications of the described embodiments incorporating the spirit and substance of the invention may occur to persons skilled in the art, the scope of the invention should be construed to include all variations falling within the ambit of the appended claims and equivalents thereof.

What is claimed is:

1. An azeotropic or azeotrope-like composition consisting essentially of (a) 90.0 to 80.0% by weight of at least one hydrogen-containing fluorochlorohydrocarbon selected from the group consisting of 1,1-dichloro-2,2,3,3,3-pentafluoropropane (R225ca), 1,3-dichloro-1,1,2,2,3-pentafluoropropane (R225cb) and a mixture of (a) 1,1-dichloro-2,2,3,3,3-pentafluoropropane (R225ca) and (b) 1,3-dichloro-1,1,2,2,3-pentafluoropropane (R225cb) in an a:b weight ratio from 1:3 to 1:5.5; and (b) 10.0 to 20.0% by weight acetone; wherein the sum of (a) and (b) is 100% by weight; the composition consisting essentially of 90.0 to 80.0% by weight of 1,1-dichloro-2,2,3,3,3-pentafluoropropane (R225ca) or 1,3-dichloro-1,1,2,2,3-pentafluoropropane (R225cb) and 10.0 to 20.0% by weight of acetone boiling in a range of 51° to 56° C. at atmospheric pressure, and the compositions consisting essentially of 90.0 to 80.0% by weight of a mixture of 1,1-dichloro-2,2,3,3,3-pentafluoropropane (R225ca) and 1,3-dichloro -1,1,2,2,3-pentafluoropropane (R225cb) and 10.0 to 20.0% by weight of acetone boiling in a range of 55° to 56.5° C. at atmospheric pressure.

2. The composition of claim 1, consisting essentially of approximately 85.2% by weight 1,1-dichloro -2,2,3,3,3-pentafluoropropane (R225ca) and 14.8% by weight acetone, wherein said composition has a boiling point of approximately 55.5° C. at atmospheric pressure.

3. The composition of claim 1 consisting essentially of (a) approxiamtely 85.8% by weight of a mixture of 1,1-dichloro-2,2,3,3,3-pentafluoropropane (R225ca) and 1,3-dichloro-1,1,2,2,3-pentafluoropropane (R225cb); and (b) approximately 14.2% by weight acetone; wherein said composition has a boiling point of approximately 55.7° C. at atmospheric pressure.

4. The composition of claim 1, wherein said dichloropentafluoropropane is a mixture of (a) 1,1-dichloro -2,2,3,3,3-pentafluoropropane (R225ca) with (b) 1,3-dichloro-1,1,2,2,3-pentafluoropropane (R225cb) in an a:b weight ratio from 1:3 to 1:5.5.

5. The composition of claim 4, wherein said weight ratio is 1:4.

6. The composition of claim 1, further comprised of 0.01 to 5% by weight of a stabilizer, relative to the total mixture.

7. The composition of claim 6, wherein said stabilizer is 0.05 to 1% by weight, relative to the total mixture.

8. The composition of claim 7, wherein said stabilizer is selected from the group consisting of nitroalkane, alkylene oxide and branched alkynol.

9. A process for cleaning a surface comprised of treating said surface with the composition of claim 1.

10. The process of claim 9 wherein said treating is selected from the group consisting of immersing said surface ins aid composition; spraying said composition on siad surface; and, vapor degreasing said surface with said composition.

11. The process of claim 10, wherein said surface is a pritned circuit board contaminated with soldering flux.

* * * * *